US005904739A

United States Patent [19]

Martini et al.

[11] Patent Number: 5,904,739

[45] Date of Patent: May 18, 1999

[54] STORAGE-STABLE LIQUID BRIGHTENER FORMULATIONS

[75] Inventors: Thomas Martini, Kelkheim; Petra Rothe, Bensheim-Auerbach, both of Germany

[73] Assignee: Hoechst Aktiengesellschaft, Frankfurt, Germany

[21] Appl. No.: 08/702,884

[22] Filed: Aug. 26, 1996

[30] Foreign Application Priority Data

Aug. 25, 1995 [DE] Germany ..... 195 31 265

[51] Int. Cl.[6] ..... D06P 3/76; D06L 3/12

[52] U.S. Cl. ..... 8/648; 8/654; 8/657; 8/927; 252/301.21

[58] Field of Search ..... 8/654, 657, 648, 8/927; 252/301.22–301.32

[56] References Cited

U.S. PATENT DOCUMENTS

| | | | |
|---|---|---|---|
| 4,388,079 | 6/1983 | Suzuki et al. | 8/648 |
| 4,508,900 | 4/1985 | Schonberger et al. | 546/99 |

FOREIGN PATENT DOCUMENTS

| | | |
|---|---|---|
| 0234176 | 9/1987 | European Pat. Off. . |
| 0396503 | 11/1990 | European Pat. Off. . |

*Primary Examiner*—Margaret Einsmann
*Attorney, Agent, or Firm*—Miles B. Dearth

[57] ABSTRACT

Storage-stable liquid brightener formulations essentially comprise a basic optical brightener, an aprotic polar organic solvent and an acid.

7 Claims, No Drawings

STORAGE-STABLE LIQUID BRIGHTENER FORMULATIONS

Optical brighteners for textiles are usually marketed as aqueous formulations. Aqueous solutions which comprise the cationic compound in the form of a salt, such as, for example, a formate, acetate, lactate, sulfate and the like, are used for brightening polyacrylonitrile. These formulations are always rendered acid for stabilization, and also comprise so-called standardizing agents as stabilizers in order to avoid precipitates during storage. Acid formulations of pH<4 can lead to corrosion. In spite of standardizing agents, clouding and brown discoloration and possibly the development of odor are observed during prolonged storage of these aqueous formulations having a water content of 20 to 90%. However, such additives always present problems since concentration of these substances can occur during recycling of brightener liquors or brightener baths in the "never-dried process", which makes higher demands on disposal. Aqueous formulations also have the disadvantage that in concentrations of more than 30% of active substance, they become viscous and therefore more difficult to handle.

It has now been found that, omitting such standardizing agents, stable liquid formulations which do not precipitate in aqueous dilution can be prepared from basic optical brighteners which are used for brightening polyacrylonitrile fibers if these brighteners are dissolved in an aprotic polar organic solvent in the presence of an acid.

The invention thus relates to liquid brightener formulations which essentially comprise a basic brightener, an aprotic polar organic solvent and an acid.

Possible basic brighteners are all the known representatives of this class such are used, in particular, for brightening polyacrylonitrile. Brighteners from the group consisting of pyrazolines, benzimidazole-benzoxazolyis, (benzo)furanyl-benzimidazolyls, furan-bis-benzimidazolyls, naphthalimides and coumarins are particularly suitable for this purpose. According to the invention, the brighteners can be employed in the form of the amine base, but it is likewise also possible to use these brighteners in the form of their acid addition salts or as genuine quaternary ammonium salts.

Suitable pyrazoline brighteners are described, inter alia, in EP-A-0 234 176 and in EP-A-0 396 503 (formulae I to VI). Cationic pyrazoline brighteners which are possible are furthermore also described in "Rev. Prog. Coloration" Volume 17, 39–55 (1987). Examples of cationic brighteners from the series consisting of benzimidazolyl-benzoxazolyl compounds, (benzo)furanyl-benzimidazole compounds, coumarin compounds and naphthalimide compounds are also to be found therein.

Possible solvents for the formulations according to the invention are organic aprotic polar solvents, such as, for example, dimethylformamide, dimethyl sulfoxide, N-methylpyrrolidone, 1-methoxypropanol, acetone and other solvents of this type. Those solvents which are suitable for dissolving polyacrylanitrile, such as, for example, dimethylformamide, dimethylacetamide, dimethyl sulfoxide, N-methylpyrrolidone, dimethyl carbonate or mixtures thereof, are preferred.

Suitable acids are all those which are sufficiently soluble in the solvent, such as, for example, mono- or polybasic alkanoic acids, hydroxyalkanoic acids, alkanesulfonic acids, arylsulfonic acids, hydrogen chloride, phosphoric acid, sulfuric acid and phosphorous acid. Acid anhydrides, such as, for example, sulfur dioxide, are also suitable. Preferred acids are formic, citric, acetic and lactic acid and mixtures thereof. Mixtures of acids are also possible, for example a mixture of formic acid and lactic acid.

The brightener formulations usually comprise no further additives, but, as a result of the high dissolving power, additional additives which may be of advantage for later use can also be incorporated. Representatives which may be mentioned here are, for example, cationic or nonionic softeners, retarders or fungicides, or also sulfur compounds having a reducing action, such as are described in EP-A-0 396 503.

The amount of acid is chosen such that a pH of less than 0.1 to 9, preferably of 4.5 to 8.5, in particular of 5 to 7, is achieved. The particular preferred pH also depends on the nature of the brightener. For example, it is to be taken into account here that certain pyrazoline brighteners already decompose at pH values below 2. All the pH values mentioned were determined with a Mettler Delta 320 pH electrometer. The content of the optical brightener in the formulations according to the invention can vary within wide limits up to the saturation limit of the particular brightener in the formulation. Concentrations of 5 to 60, preferably 5 to 30% by weight of optical brightener are preferred.

The formulations according to the invention are prepared by simply mixing or stirring the individual components, the sequence of the addition not being critical. Usually, the optical brightener is stirred into the solvent and the desired pH is established with the acid. To accelerate the mixing operation, the solvent can also be heated gently up to about 50° C., but in general mixing is carried out at room temperature.

The formulations according to the invention are clear solutions which are distinguished by a high storage stability. Furthermore, very much higher concentrations of optical brighteners can be achieved by this route than in the case of conventional aqueous formulations. The formulations are used for brightening polyacrylonitrile fibers and are preferably employed during spinning of these fibers in the gel phase. The formulations according to the invention can be used undiluted or after dilution with water. Even in a dilution with water in a ratio of $1:10^6$–$10^7$, clear aqueous solutions without precipitates are obtained. As an alternative to the procedure described above, a procedure can also be followed in which the brightener formulation is prepared without acid and this acid-free formulation is added to an aqueous bath which comprises the necessary amount of acid.

EXAMPLE 1

30 g of an amine base of the formula

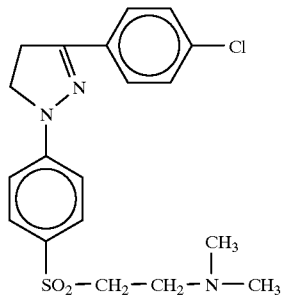

(1)

are stirred into 153 g of dimethylformamide. The cloudy mixture has a pH of 11. A clear, light-colored solution with a pH of 6 is obtained by addition of 10 g of anhydrous HCOOH (99.9%). The light-colored and clear formulation is stored at 40° C. for 14 days and shows no clouding or brown discoloration.

EXAMPLE 2 (comparison)

15 g of the brightener base from Example 1 are dissolved in a mixture of 6 g of HCOOH and 50 ml of water. The solution is diluted to 100 ml with water and filtered. After standing at 40° C. for only 24 hours, a slight sediment forms.

EXAMPLE 3

30 g of the amine base from Example 1 are stirred with 105 g of N-methylpyrrolidone and the pH is brought to 6.0 with 22 g of lactic acid. A storage-stable, clear, light-colored formulation which shows no clouding and has not become subsequently dark even after 14 days at 40° C. is obtained.

EXAMPLE 4

The procedure is as in Example 3. However, N,N-dimethylacetamide is used as the solvent. 29 g of lactic acid are added to establish the pH of 6. A clear, light-colored, storage-stable formulation which shows no clouding and does not subsequently become dark even after 14 days at 40° C. is obtained.

EXAMPLE 5

The procedure is as described under Example 1, but a brightener base of the formula

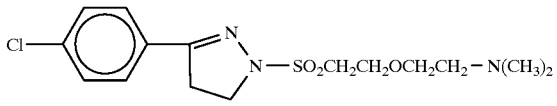

is employed. A clear, light-colored, storage-stable formulation is obtained.

EXAMPLE 6

7.5 g of the amine base from Example 1 are stirred into 52 g of dimethylformamide. A cloudy solution which already becomes clear at pH 8.3 by addition of glacial acetic acid is obtained. When a total of 6.28 g of glacial acetic acid is added, a pH of 6.42 is obtained. A light-colored, clear, storage-stable solution which shows no clouding or brown discoloration even after standing at 40° C. for 14 days is obtained.

EXAMPLE 7

75 g of the amine base from Example 1 were stirred into 75 ml of dimethylformamide and brought to pH 3.2 with 50 g of HCOOH. A clear, storage-stable formulation which is significantly less viscous than an analogous water-based formulation having a content of amine base of 35% is obtained.

EXAMPLE 8

20 ml of dimethylformamide are added to 5 g of a brightener salt of the formula

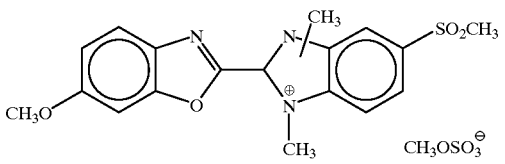

A suspension having a pH of 2.19 is obtained. After addition of 6.5 g of HCOOH, a dark, clear, stable solution having a pH of 1.52 is obtained. If water is used instead of dimethylformamide, a thick suspension of pH 1.35 is initially obtained. A solution of pH 1.12 is obtained by addition of 6.5 g of HCOOH.

EXAMPLE 9

13.5 g of the brightener base from Example 1 are added to 100 g of lactic acid. After standing for 1 week at room temperature, 11 g thereof have dissolved. The remaining 2.5 g of the undissolved amine base can be dissolved very easily by addition of 5 g of dimethylformamide.

EXAMPLE 10

The procedure is as under Example 7. The resulting solution is stirred with 1 g of $Na_2S_2O_4$ for 5 minutes. The solid substance is then filtered off. A greenish, stable brightener formulation is obtained.

EXAMPLE 11

15 g of citric acid, 2 g of formic acid and 15 g of the brightener base from Example 1 are stirred into 135 g of N-methylpyrrolidone. A light-colored, stable formulation is obtained.

EXAMPLE 12

Polyacrylonitrile fabric is brightened with the formulation according to Example 6 by the exhaustion process and compared with an aqueous formulation provided with the same content of active substance (pH 2.7; HCOOH).

Recipe 1 g/l of a nonionic wetting agent,

HCOOH, pH 3, 0.4% formulation according to Example 6 or analogous aqueous formulation, liquor ratio 1:30

30 minutes at 95° C.

Result

White effects which are equally as good as those with the analogous conventional aqueous formulation are obtained with the formulation according to the invention.

We claim:

1. A storage-stable liquid brightener formulation comprising a basic optical brightener, an aprotic polar organic solvent and an acid wherein said formulation is non-aqueous.

2. A brightener formulation as claimed in claim 1, in which the basic optical brightener is present in the form of the free amine base.

3. A brightener formulation as claimed in claim 1, in which the pH is 0.1 to 9.

4. A process for the preparation of a brightener formulation as claimed in claim 1, which comprises dissolving the acid and the brightener in the solvent.

5. A method of brightening polyacrylonitrile which comprises contacting polyacrylonitrile with the brightener formulation as claimed in claim 1.

6. A brightener formulation as claimed in claim 1, which comprises, as the solvent, dimethylformamide, dimethylacetamide, methyl acetamide, dimethyl sulfoxide, N-methylpyrrolidone or dimethyl carbonate.

7. A brightener mixture as claimed in claim 1, which comprises formic, acetic, lactic or citric acid as the acid.

* * * * *